United States Patent [19]

Matsumoto et al.

[11] 3,958,326

[45] May 25, 1976

[54] METHOD OF MANUFACTURING COMMUTATOR

[75] Inventors: Kazuo Matsumoto, Anjo; Toshihiro Kobayashi, Gamagori, both of Japan

[73] Assignee: Nippondenso Co., Ltd., Japan

[22] Filed: Jan. 14, 1975

[21] Appl. No.: 540,797

[30] Foreign Application Priority Data

Mar. 3, 1974 Japan ..... 49-29531

[52] U.S. Cl. ..... 29/597; 29/418

[51] Int. Cl.[2] ..... H01R 43/08

[58] Field of Search ..... 29/597, 418; 310/235, 310/236, 42

[56] References Cited

UNITED STATES PATENTS

| | | | |
|---|---|---|---|
| 3,102,965 | 9/1963 | Ickes et al. | 29/597 |
| 3,423,819 | 1/1969 | Carlson et al. | 29/597 |

*Primary Examiner*—Carl E. Hall

*Attorney, Agent, or Firm*—Cushman, Darby & Cushman

[57] ABSTRACT

A method of manufacturing a commutator whereby first, a straight length of copper metal is formed into a circular commutator blank with a parallel space formed by both ends of the straight length of metal; second, the commutator blank is positioned on a lower die of an extrusion press machine in order that the parallel space of the commutator blank is aligned with a plane on which one of cutting edges of a mandrel of the extrusion press machine is placed; third, the commutator blank is extruded to form a segment ring having parallel gaps inside the segment and bridging portions formed across the outer ends of the gaps, whereby the parallel space is elongated along one of the bridging portions; fourth, the segment ring is molded with an insulating material; finally, the outer surface of the segment ring is cut to remove the bridging portions, thereby to complete the commutator.

6 Claims, 9 Drawing Figures

METHOD OF MANUFACTURING COMMUTATOR

BACKGROUND OF THE INVENTION

1. Field of the Invention

The present invention relates to a method of manufacturing a commutator for electric rotary machines mounted in an automotive vehicle.

2. Description of the Prior Art

A conventional method of manufacturing a commutator, for example, as exemplified in U.S. Pat. No. 3,423,819, comprises substantially the following steps; first, the copper metal is formed into a generally circular configuration desired for the elongated commutator blank, with one end of the length of the metal positioned adjacent the other end of the length of the metal in parallel, spaced relationship therebetween; second, the copper metal in the area adjacent the two ends of the length is subjected to an electron beam welding operation so as to form a welded joint between the two ends; third, the copper metal formed to a continuous and circular commutator blank is annealed so as to relieve all stresses and strains developed therein during both the forming and electron beam welding steps; fourth, the commutator blank is immersed in a soap solution for the subsequent extrusion operation; fifth, the commutator blank is extruded to form a segment ring having bridging portions formed across gaps between commutator segments and flanged portion for connecting armature windings; sixth, holding claws are provided on inner surfaces of the commutator segments; seventh, the segment ring is molded with an insulating material; eighth, the outer surface of the segment ring is cut to remove the bridging portions thereby to divide the segment ring into individual segments.

The above described method of making the commutator, however, has disadvantages that the electron beam welding step must be carried out in a vacuum furnace which results in a batch processing or a lot production, whereby commercial quantity production is hardly achieved, that the vacuum furnace requires a large-scale vacuum pump and electric equipment to supply a high voltage, and that large-scale equipment for heat-treatment is required to form homogeneous metallographical properties.

SUMMARY OF THE INVENTION

Therefore, it is a principal object of the present invention to provide a method of manufacturing commutators, which does not require an electron beam welding step and a heat-treatment.

It is another object of the present invention to provide a method of manufacturing commutators which can be produced not through the batch processing but through a continuous producing process.

It is a further object of the present invention to provide a method of manufacturing commutators, by which the cost of equipment can be reduced.

Other objects and advantages can be more readily realized when the specification is considered in conjunction with the attached drawings.

DESCRIPTION OF THE PREFERRED EMBODIMENT

Figure 1:
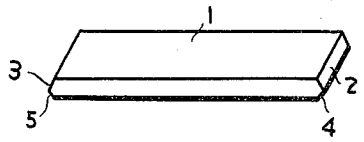
FIG. 1 is a perspective view of a relatively straight copper metal band.

In FIG. 1, a relatively straight piece of copper metal is designated by numeral 1, whose ends 2 and 3 are slightly tapered to facilitate the bending of the copper metal into a circular configuration. The copper metal 1 is further formed with tapered portion at its ends to form a locating portion when the copper metal 1 is formed into the circular configuration.

Figure 2:
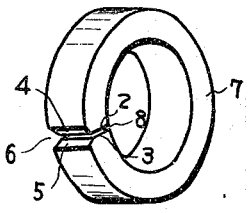
FIG. 2 is a perspective view of a circular commutator blank formed from the copper metal band shown in FIG. 1.

In FIG. 2, a circular commutator blank is designated by a numeral 7 which is formed from the relatively straight copper metal piece 1 by press forming, for instance. A facing portion 8 of the tapered ends 2 and 3 forms a parallel space in which said ends 2 and 3 are positioned adjacent and spaced in parallel with each other, and the locating portion 6 is formed by the tapered ends 4 and 5.

Then the circular commutator blank 7 is subjected to a lubricating treatment for the subsequent extrusion operation. For example, lubrication may include plating the circular commutator blank with Zinc, to form thereafter a Zinc phosphate film, and finally forming a metallic soap film on the blank.

Figure 3:
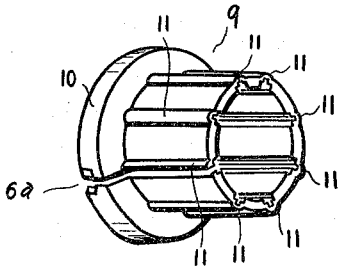
FIG. 3 is a perspective view of a segment ring formed from the circular commutator blank shown in FIG. 2 by extrusion.

A segment ring designated by a numeral 9 in FIG. 3 is formed by extrusion, with a flanged portion 10 and a plurality of parallel gaps on the inside of the segment ring and bridging portions 11 formed across the outer ends of the gaps. The locating portion 6 of the blank 7 before the extrusion remains as it is seen and designated by a numeral 6*a* in FIG. 3 after the extrusion.

Figure 4:
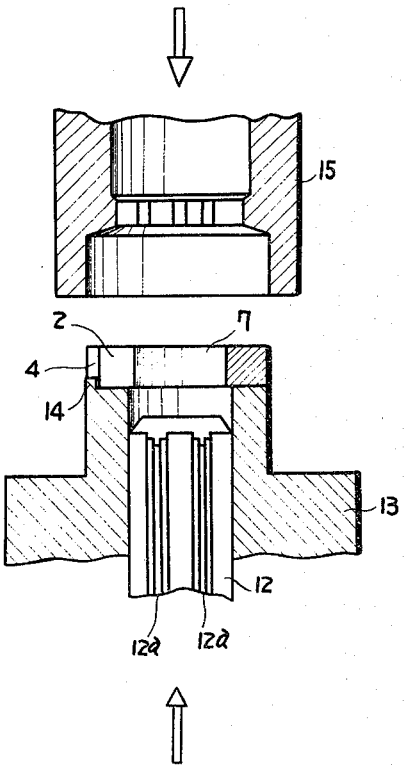
FIG. 4 is a sectional view of the circular commutator blank and a main portion of a press machine during an extruding process, in which FIG. 4 (A) shows the commutator blank before extruded, and FIG. 4 (B) after extruded.
Figure 4:
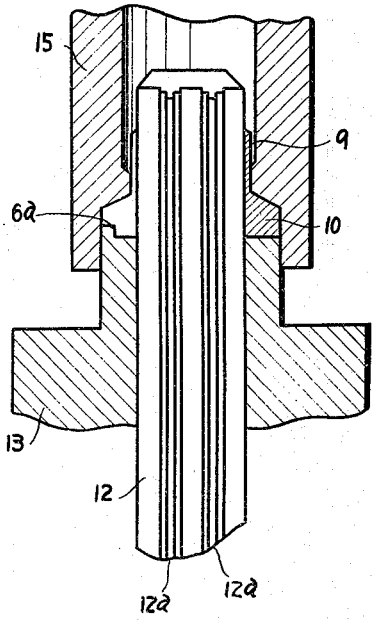

FIG. 4 (A) shows an extrusion press machine before extruding, in which a lower die is designated by a numeral 13 and an upper die is designated by a numeral 15. A projection 14 is provided on the lower die 13 for engaging with the locating portion 6 of the commutator blank 7 for locating the blank 7 in position.

FIG. 4 (B) shows the same part of the press machine after extrusion, in which the upper die 15 is moved downwardly and a mandrel 12 is moved upwardly, whereby the commutator blank is completed to form the segment ring 9.

The projection 14 is so positioned on the lower die 13 that the parallel space 8 of the circular commutator blank is located in a plane on which one of cutting edges 12*a* of the mandrel 12 is placed, whereby the parallel space is elongated and positioned along a line on which one of the parallel gaps and one of the bridging portions are formed.

Figure 5:
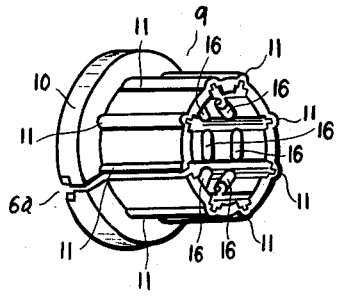
FIG. 5 is a perspective view of the segment ring formed with holding claws.
Figure 6:
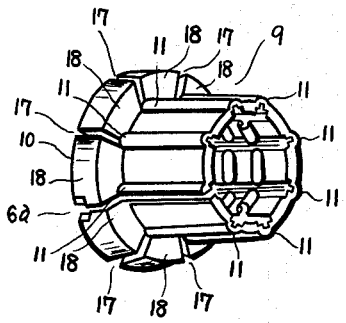
FIG. 6 is a perspective view of the segment ring whose flanged portion is formed with dividing grooves.

After extrusion, the segment ring 9 is formed with holding claws 16 respectively on each segment as shown in FIG. 5, and thereafter the flanged portion 10 is divided into flanged segments 18 by dividing grooves 17 formed along lines extending from the bridging portions 11 as shown in FIG. 6.

Then the segment ring 9 is molded with an insulating material such as phenolic resin.

Figure 7:
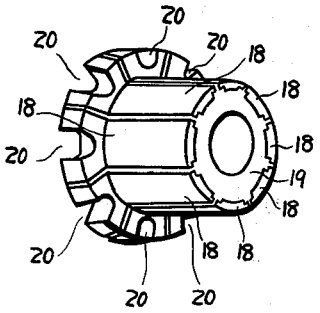
FIG. 7 is a perspective view of a commutator formed by the method of the present invention.

The outer peripheral surface of the molded segment ring is cut to remove the bridging portions, thereby to divide the segment ring into individual segments held by the insulating material. The flanged segments 18 are formed with concave portions 20, as shown in FIG. 7, for connecting the segments with armature windings, thereby to finish a commutator.

Figure 8:
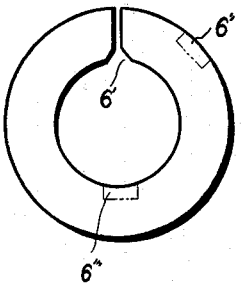
FIG. 8 is a top view of a commutator blank illustrating other modifications.

In the above described embodiment, the locating portion is formed at the outer surface of the circular commutator blank, however, the locating portion may be formed at the inner surface of the blank as designated by the numeral 6' in FIG. 8. In this instance, the locating portion 6' is positioned on the lower die of the press machine in order that the parallel space is aligned with a plane of one of the cutting edges of the mandrel.

Further, the locating portion may be formed at any place of the outer or the inner surface of the circular commutator blank, as designated by the numeral 6'' or 6''' in FIG. 8 either before forming the commutator blank or thereafter.

Also the locating portion may be omitted so far as the parallel space of the commutator blank is positioned to align with a plane on which one of cutting edges of the mandrel of the extrusion press machine is placed.

What we claim is:

1. A method of manufacturing a commutator comprising the steps of;

preparing a straight length of metal with two ends, each end having a first and second tapered portion;

forming said straight length of metal into a circular commutator blank, said two ends being positioned adjacent each other, thereby to form a parallel space by said first tapered portions spaced in parallel with each other and to form a locating portion by said second tapered portions;

inserting said circular commutator blank into an extrusion press having an upper and a lower die and a mandrel;

locating said locating portion of said circular commutator blank on a projection provided on said lower die, thereby to locate said parallel space in a plane in which one of a plurality of cutting edges of said mandrel is placed;

extruding said circular commutator blank, thereby to elongate the metal of said blank to form a segment ring including a flanged portion and a plurality of gaps on the inside thereof and bridging portions formed across the outer ends of said gaps, said parallel space being elongated and positioned along a line of one of said bridging portions;

cutting radially said flanged portion, thereby to divide same into individual flanged segments;

molding said segment ring with an insulating material; and cutting the outer peripheral surface of said segment ring to remove said bridging portions thereby to complete a commutator.

2. A method of manufacturing a commutator comprising the steps of;

preparing a straight length of metal with tapered ends;

forming a locating portion on said straight length of metal;

forming said straight length of metal into a circular commutator blank, said ends being positioned adjacent and spaced in parallel with each other, thereby to form a parallel space;

inserting said circular commutator blank into an extrusion press;

locating said parallel space of said circular commutator blank by said locating portion in a plane in which one of a plurality of cutting edges of a mandrel of said extrusion press is placed;

extruding said circular commutator blank, thereby to elongate the metal thereof to form a segment ring including a plurality of parallel gaps on the inside thereof and bridging portions formed across the outer ends of said gaps, said parallel space being elongated and positioned along a line of one of said bridging portions;

molding said segment ring with an insulating material; and cutting the outer peripheral surface of said segment ring to remove said bridging portions, thereby to complete a commutator.

3. A method of manufacturing a commutator comprising the steps of;

preparing a straight length of metal with tapered ends;

forming said straight length of metal into a circular commutator blank, said ends being positioned adjacent and spaced in parallel with each other, thereby to form a parallel space;

forming a locating portion on said circular commutator blank;

inserting said circular commutator blank into an extrusion press;

locating said parallel space of said circular commutator blank by said locating portion in a plane in which one of a plurality of cutting edges of a mandrel of said extrusion press is placed;

extruding said circular commutator blank, thereby to elongate the metal thereof and to form a segment ring including a plurality of parallel gaps on the inside thereof and bridging portions formed across the outer ends of said gaps, said parallel space being elongated and positioned along a line of one of said bridging portions;

molding said segment ring with an insulating material; and cutting the outer peripheral surface of said segment ring to remove said bridging portions, thereby to complete a commutator.

4. A method of manufacturing a commutator comprising the steps of:

preparing a straight length of metal with tapered ends;

forming said straight length of metal into a circular commutator blank, said ends being positioned adjacent and spaced in parallel with each other, thereby to form a parallel space;

forming a locating portion at said parallel space of said circular commutator blank;

inserting said circular commutator blank into an extrusion press;

locating said parallel space of said circular commutator blank by said locating portion in a plane in which one of a plurality of cutting edges of a mandrel of said extrusion press is placed;

extruding said circular commutator blank, thereby to elongate the metal thereof and form a segment ring including a plurality of parallel gaps on the inside thereof and bridging portions formed across the outer ends of said gaps, said parallel space being elongated and positioned along a line of one of said bridging portions;

molding said segment ring with an insulating material; and cutting the outer peripheral surface of said segment ring to remove said bridging portions, thereby to complete a commutator.

5. A method of manufacturing a commutator comprising the steps of;

preparing a straight length of metal with two ends;

forming said straight length of metal with first tapered portions at both ends;

forming said straight length of metal with a second tapered portion at one of said two ends;

forming said straight length of metal into a circular commutator blank, said two ends being positioned adjacent each other, thereby to form a parallel space by said first tapered portions spaced in parallel with each other and to form a locating portion by said second tapered portion;

inserting said circular commutator blank into an extrusion press;

locating said parallel space of said circular commutator blank by said locating portion in a plane in which one of a plurality of cutting edges of a mandrel of said extrusion press is placed;

extruding said circular commutator blank, thereby to elongate the metal thereof and form a segment ring including a plurality of parallel gaps on the inside thereof and bridging portions formed across the outer ends of said gaps, said parallel space being elongated and positioned along a line of one of said bridging portions;

molding said segment ring with an insulating material;

cutting the outer peripheral surface of said segment ring to remove said bridging portions, thereby to complete a commutator.

6. A method of manufacturing a commutator comprising the steps of;

preparing a straight length of metal with tapered ends;

forming said straight length of metal into a circular commutator blank, said ends being positioned adjacent and spaced in parallel with each other thereby to form a parallel space;

inserting said circular commutator blank into an extrusion press;

locating said parallel space of said circular commutator blank in a plane in which one of a plurality of cutting edges of a mandrel of said extrusion press is placed;

extruding said circular commutator blank, thereby to elongate the metal thereof and form a segment ring including a plurality of parallel gaps on the inside thereof and bridging portions formed across the outer ends of said gaps, said parallel space being elongated and positioned along a line of one of said bridging portions;

molding said segment ring with an insulating material; and cutting the outer peripheral surface of said segment ring to remove said bridging portions, thereby to complete a commutator.

* * * * *